United States Patent [19]

Potts

[11] 4,314,727

[45] Feb. 9, 1982

[54] ALL-PURPOSE WEATHER GUARD

[76] Inventor: James H. Potts, 220 S. 43rd St., Tacoma, Wash. 98408

[21] Appl. No.: 144,484

[22] Filed: May 5, 1980

[51] Int. Cl.[3] ..... A47C 7/00

[52] U.S. Cl. ..... 297/184; 5/113

[58] Field of Search ..... 297/184, 217; 5/113

[56] References Cited

U.S. PATENT DOCUMENTS

| | | | |
|---|---|---|---|
| 3,224,806 | 12/1965 | Butters et al. | 297/184 X |
| 3,258,291 | 6/1966 | Ezquerra | 297/184 X |
| 3,456,980 | 7/1969 | Battistoni et al. | 297/184 |
| 3,467,346 | 9/1969 | Carson, Jr. | 297/184 X |
| 3,747,974 | 7/1973 | Tauzin | 297/184 |
| 3,873,117 | 3/1975 | Perego | 297/184 X |
| 4,027,915 | 6/1977 | Anderson et al. | 297/184 |
| 4,093,305 | 6/1978 | Staroste | 297/184 |
| 4,131,312 | 12/1978 | Price | 297/184 |

*Primary Examiner*—Roy D. Frazier
*Assistant Examiner*—Peter A. Aschenbrenner

[57] ABSTRACT

A weather guard for quick-release attachment to a child's car seat to include a transparent shatter-proof bubble, having manually activated air vents, moisture collection trough on all sides, flexible rain diversion spouts, and a padded bottom edge, and attached to the upper half of existing children car seats by the use of quick-disconnecting snaps, loop and pile fasteners, or some other suitable devise.

3 Claims, 5 Drawing Figures

ALL-PURPOSE WEATHER GUARD

BACKGROUND OF THE INVENTION

1. Field of Invention

This invention relates to an improvement in weather hoods for child carriers and more particularly to an improvement to a weather shield for quick-release attachment to children's car seats, which provides protection from rain, wind, sun, and irritants.

2. Description of Prior Art

It is known that child carriers can be equipped with bonnets, hoods, transparent visors, and like devices. Such known prior devices were single purpose or did not provide the quick access necessary for utilization on a child's car seat, for emergency evacuations.

The applicant has commissioned a patent search for conflicting prior art through the firm of Shlesinger, Arkwright, Garvey & Dinsmore, and cites the following United States patents as having been considered and found not conflicting for the reasons indicated:

| Patent No. | Date | Inventor | Class |
|---|---|---|---|
| 2,088,200 | 7/27/37 | J. Glick | 280/47.38 |

The Glick patent discloses the classic baby carriage, equipped with a collapsible bonnet. The traditional carriage bonnet is heavy and locks into position, so that its design would not be adaptable to children's car seats where the quick-disconnect feature is critical in emergency situations. It is also not anticipatory to the Potts invention as it is not transparent. The Glick patent itself claims only the inclusion of a clock in the traditional carriage and therefore does not anticipate the Potts invention.

| Patent No. | Date | Inventor | Class |
|---|---|---|---|
| 2,546,843 | 3/27/51 | N. Zigterman | 5/416 |

The Zigterman patent discloses a storm and insect shield for use on baby carriages. This device, likewise, is installed so that emergency evacuation of the child is impeded. In addition, it depends upon the underlying structure for support away from the child, while most car seats do not provide sufficient side depth. Perhaps the main drawback to this invention is that it precipitates a claustrophobic area around the child and air circulation around the child is restricted, thus being a health hazard in warm climates. The Potts invention, providing for its own support away from the child, air circulation, and quick disconnection, solves the insufficiencies of the Zigterman patent.

| Patent No. | Date | Inventor | Class |
|---|---|---|---|
| 3,873,117 | 3/25/75 | G. Perego | 297/184 |

The Perego patent discloses a baby stroller equipped with a collapsible parasol and fabric cover for the lower part of the child's body. The Perego patent does not provide a weather guard against wind and/or rain from the front of the stroller and fails to allow quick access to the child in case of the need for emergency evacuation. It is therefore not applicable to children's car seats and does not anticipate the Potts invention.

| Patent No. | Date | Inventor | Class |
|---|---|---|---|
| 4,072,345 | 2/7/78 | A. Matsuda | 197/184 |

The Matsuda patent discloses a removable cover for the rear of a baby stroller, for the purpose of aerating the internal stroller area. Although the Matsuda patent recognizes and attempts to solve the air circulation problem in strollers, it it not applicable to children's car seats which fit against the rear of a passenger seat. The Matsuda patent does not provide the protection from the elements as does the Potts invention.

| Patent No. | Date | Inventor | Class |
|---|---|---|---|
| 4,027,915 | 6/7/77 | D. Anderson | 297/184 |

At first glance, the Anderson patent would appear to disclose a device similar to the Potts invention. However, an analysis of the Anderson patent, its objects and claims reveals that it does not anticipate the improvements of the Potts invention over the prior art. The Anderson patent discloses a clear plastic sun shield attachable to a child's car seat by a pair of adhesive backed mounting brackets. The claims of the Anderson patent apply primarily to the method of attachment, which is not contemplated in the Potts invention.

The Anderson patent discloses a sun visor which is free to rotate on the mounting brackets at the top of the car seat. It does not provide a means for securing the visor against the force of wind or changes in motion of the vehicle, thus it presents a danger to the appendages of a child in the car seat as fingers could be struck by the sides of the visor, were it extended a sufficient distance to protect the torso of the child. The bubble visor, as disclosed in the Anderson patent, does not provide a seal against wind or rain entering the seat from above, nor does it provide a means to direct moisture run-off from the visor, away from the interior of the car seat. All of these deficiencies in the Anderson patent are satisfied by the Potts invention.

OBJECTS AND SUMMARY OF THE INVENTION

OBJECTS

It is therefore a general object of the invention to provide a transparent guard against wind, weather, and sun for attachment to existing children's car seats.

It is a specific object of the invention to provide a novel weather guard for children's car seats which permits quick release of said guard in order to evacuate the child therefrom in an emergency.

It is a further object of the invention to provide a novel weather guard for children's car seats which has a means to facilitate air circulation under the guard and around the child, which said means may be manually controlled.

It is a further object of the invention to provide a novel weather guard for children's car seats which has a means for collecting and dispursing water, from the outer surface of the guard, away from the interior of the car seat.

It is a further object of the invention to provide a novel weather guard for children's car seats which accomplishes the foregoing general and specific objectives at an inexpensive price and with the utmost concern for traveling safety in its design, i.e. soft plastic spouts, protrusion of the guard out of the reach of the child's head during sudden deceleration, and padding of the access area to protect the adult's arms.

BRIEF SUMMARY

According to the present invention, there is provided a weather guard assembly for quick-releasable attachment to existing children's car seats, comprising in combination: a transparent and/or tinted shatterproof guard having a top and front panel and two opposing sides, of sufficient height so that the front panel is displaced from the front edge of the car seat a distance sufficient to prevent the head of the child contacting its inner face during a sudden deceleration, a lip perpendicular to the sides and front of the guard, running its entire length and width for the transport of water from its surface and ending in a flexible plastic spout at the bottom front corners of the guard on either side of the car seat, said lips along the sides being equipped with the female portion of snaps or a suitable alternative such as loop and pile fasteners, at regularly spaced intervals along their underside, and manually activated slide vent in each rear corner of the top; the male portion of snaps, or a suitable alternative such as velcro tape, adhesively affixable to the exposed edge of the sides of the car seat, directly opposing the female portions on the lips of the guard; the termination of the sides of the guard being constructed so as to fit the contour of the sides and top of the car seat; the underside of the lip across the front of the guard being lined with a suitable padding material so as to protect the forearms of the individual extracting the child as they disconnect the guard.

This weather guard is immediately applicable to children's car seats, although other applications will be obvious to one reasonably skilled in the art.

DESCRIPTION OF PREFERRED EMBODIMENTS

Figure 1:
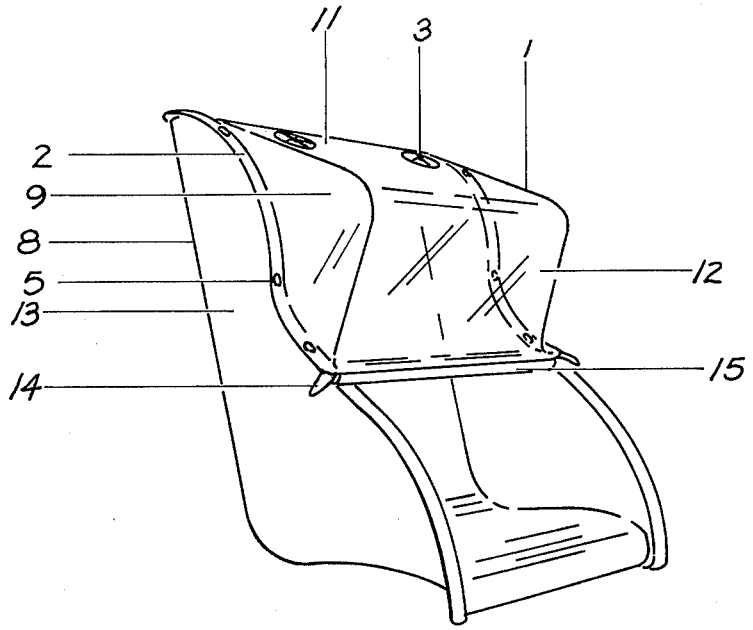
FIG. 1 is a perspective view of the child's car seat with the All-Purpose Weather Guard attached.
Figure 2:
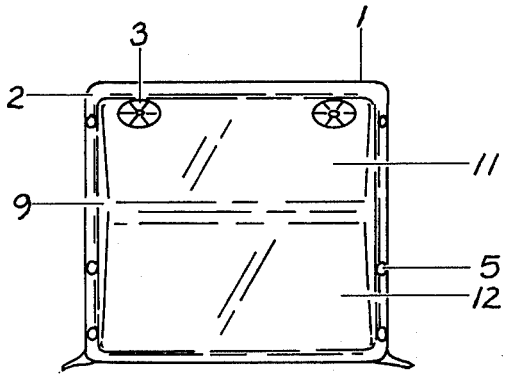
FIG. 2 is a frontal view of the All-Purpose Weather Guard apart from the child's car seat.

Referring to the drawings, and in particular FIG. 1, there is shown a weather guard (1) constructed in accordance with the invention and attached to the child's car seat (8). It will be observed that the guard is attached to the sides of the car seat via snaps and extends well down the face of the car seat opening from the top of the seat.

The weather guard (1) comprises a transparent cover having opposing sides (9) which extend the top (11) and face (12) of the guard away from the sides of the car seat (13) a sufficient distance, so that the child's head will not impact the inner surface of the guard in the event of rapid deceleration. The guard (1) and its components, except for the water spout (14) and fasteners (5), are preferably made of transparent shatterproof plastic material. This enables the one-step manufacture of the guard, so as to minimize its cost, and also allows the view of the child to be unobstructed by the guard.

The weather guard (1) is equipped with a lip (2), perpendicular to the sides (9) and front (12) of the guard, running its entire length and width for the transport of water, collected from the outer surface of the guard (1). These lips (2) are concave and terminate into the spouts (14), on either side of the guard. These spouts (14) are preferably constructed of flexible plastic so that they are not a hazard to other passengers in the car. Said spouts (14) effectively direct the water over the sides (13) of the car seat (8). Into the underside of the lip (14) on either side of the guard are permanently affixed the female portion of snaps (5), or a suitable alternative such as loop and pile fastness, set at regularly spaced intervals. The underside of the lip (14) along the bottom of the guard face (12) is equipped with a permanently affixed cushioning material (15) along its entire length, so as to protect an individual's forearms when disconnecting the guard (1) from the seat (8) and removing the child in an emergency.

Figure 3:
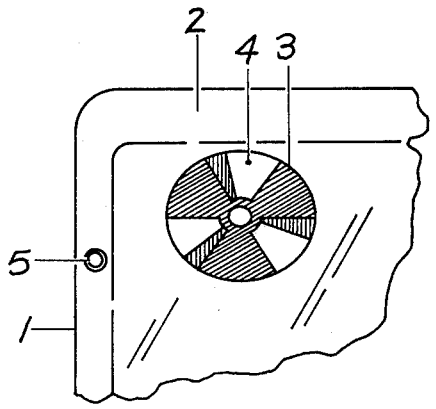
FIG. 3 is an expanded view of the manually adjustable air vent.

Air circulation beneath the guard (1) is facilitated by the manually-operated slide vents (3), located in each rear corner of the top (11). FIG. 3 shows an expanded view of one of these air vents (4), depicting the rotating cover (3) and the air openings (4), through which outside air is allowed to pass in order to minimize the "greenhouse" effect under the guard (1). The solid cover (3) is rotated around its fixed axis (16) to expose or cover the air vents (4).

Figure 4:
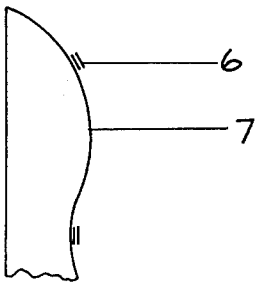
FIG. 4 is a side view of the side of the child's car seat with the male portion of the snaps affixed.
Figure 5:
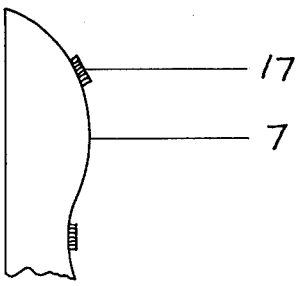
FIG. 5 is a side view of the side of the child's car seat with an alternative means of fastening, i.e. loop and pile fasteners.

In order to install this weather guard on existing car seats, the male portion (6) of snaps are adhesively affixed, to the front edge (7) of the sides (13) of the car seat, at points in opposition to the female portions (5) set in the guard lip (2). This is shown in FIG. 4. FIG. 5 shows the alternative use of loop and pile fasteners (17) in the place of snaps (5 and 6).

Although the invention has been described with reference to preferred embodiments, it will be appreciated by those skilled in the art that additions, deletions, modifications, and substitutions and other changes not specifically described may be made which will fall within the purview of the appended claims.

I claim:

1. A weather guard assembly for quick-releasable attachment to the forward face of the sides and top of a child's car seat, comprising in combination:

a transparent shatterproof guard having a top and front panel and two opposing sides, with their base of a configuration complementary to that of the corresponding sides of the child's car seat, and having a lip perpendicular to the sides and front of the guard, running its entire length and width, with a concave upper surface, ending at a flexible spout, protruding perpendicular to the side of the child's car seat, at the bottom front corners of the guard, and having the underside of the lip across the front panel covered with a padding material of suitable resiliancy;

a triple orifice air vent, at both rear corners of the guard top panel, with said openings having a common axis to which is rotatably attached an impervious cover, having openings cooperable with the openings in the guard top panel when aligned therewith and corresponding solid portions opposing the openings in the guard top panel when aligned therewith; and means on the undersurface of the lips on the sides of said weather guard to quick-releasably attach the guard to a cooperable positioned means, permanently affixed to the forward face of the sides of the child's car seat, with said means regularly spaced along the sides of the car seat and correspondingly spaced along the undersurface of the lip on the sides of the guard.

2. A weather guard assembly according to claim One, wherein the female portion of snaps are imbedded and regularly spaced along the undersurface of the lip on the sides of the guard and the male portion of snaps are permanently affixed to the front face of the sides of the child's car seat, at points opposing the female portion of the snapes, by a suitable means, i.e. adhesive.

3. A weather guard assembly according to claim One, wherein the reverse side of the female portions of loop pile fasteners is permanently affixed to the undersurface of the lip on the sides of said guard at regularly spaced intervals and the reverse side of the male portions of velcro tape is permanently affixed to the front face of the sides of the child's car seat, at points opposing the female portions on the lip by a suitable means, i.e. adhesive.

* * * * *